US005242363A

United States Patent [19]

Nitta et al.

[11] Patent Number: 5,242,363

[45] Date of Patent: Sep. 7, 1993

[54] WATER COOLED ROLLS FOR COOLING STEEL SHEETS

[75] Inventors: Hideo Nitta; Mamoru Hisada, both of Kitamoto, Japan

[73] Assignee: Praxair S.T. Technology, Inc., Danbury, Conn.

[21] Appl. No.: 928,189

[22] Filed: Aug. 14, 1992

Related U.S. Application Data

[63] Continuation of Ser. No. 736,590, Jul. 26, 1991, abandoned.

[30] Foreign Application Priority Data

Jul. 27, 1990 [JP] Japan ..... 2-79303[U]

[51] Int. Cl.[5] ..... B21B 31/08

[52] U.S. Cl. ..... 492/54; 492/53

[58] Field of Search ..... 29/130, 132; 492/46, 492/53, 54, 58; 271/293

[56] References Cited

U.S. PATENT DOCUMENTS

| | | | |
|---|---|---|---|
| 3,639,639 | 2/1972 | McCord | 29/132 X |
| 4,727,740 | 3/1988 | Yabuki et al. | 29/132 X |
| 4,748,736 | 6/1988 | Miihkinen | 29/132 X |
| 4,756,180 | 7/1988 | Higuchi et al. | 29/132 X |
| 4,839,949 | 6/1989 | Sobue et al. | 29/132 |
| 4,856,161 | 8/1989 | Miihkinen | 29/132 X |
| 4,912,835 | 4/1990 | Harada et al. | 29/110 X |
| 4,951,392 | 8/1990 | Miihkinen | 29/130 X |
| 5,023,985 | 6/1991 | Salo et al. | 29/132 |
| 5,040,398 | 8/1991 | Nakagawa et al. | 29/132 X |
| 5,070,587 | 12/1991 | Nakahira et al. | 29/132 |
| 5,111,567 | 5/1992 | Leino et al. | 29/132 |
| 5,123,152 | 6/1992 | Tenkula et al. | 29/132 |

FOREIGN PATENT DOCUMENTS

| | | | |
|---|---|---|---|
| 60-143767 | 9/1985 | Japan . | |
| 61-130426 | 6/1986 | Japan . | |
| 61-136634 | 6/1986 | Japan . | |
| 63-64760 | 4/1988 | Japan . | |
| 3101012 | 5/1988 | Japan | 29/132 |

OTHER PUBLICATIONS

Kobe Steel Engineering Reports, vol. 36, No. 3 (1986) pp. 13–17, "Roll Quenching Technique in Continuous Annealing Line", Shigeharu Itoh, et al.

*Primary Examiner*—Timothy V. Eley
*Assistant Examiner*—C. Richard Martin
*Attorney, Agent, or Firm*—Cornelius F. O'Brien

[57] ABSTRACT

A water-cooled roll for cooling steel sheets is spray-coated on the surface that comes in contact with the steel sheets with a cermet composed of a metal oxide having a higher hardness and lower thermal conductivity than metals and a metal matrix of Ni- or Co-base heat-resisting alloy. The metal oxide is chosen from among $Al_2O_3$, $Cr_2O_3$, $SiO_2$, and $ZrO_2$, and the metal matrix consists of an MCrAlY (M=Co or Ni). Preferably, the metal oxide is alumina and the metal matrix, CoCrAlYTa.

4 Claims, 1 Drawing Sheet

WATER COOLED ROLLS FOR COOLING STEEL SHEETS

This application is a continuation of prior U.S. application Ser. No. 07/736,590 filed Jul. 26, 1991, now abandoned.

BACKGROUND OF THE INVENTION

This invention relates to a technique for improving the surface characteristics of water-cooled rolls to be used for cooling steel sheets in heat-treating furnaces.

Continuous annealing furnaces for steel sheets are provided with a quenching zone to help produce well-aged cold-rolled sheets or the like. One method of cooling in that zone uses water-cooled rolls.

FIG. 1 illustrates the concept of the roll cooling. An array of internally water-cooled metal rolls 1 cools a steel sheet 2 as the latter passes in direct contact with the rolls, under control such that the work is cooled down to a given finish temperature at a controlled rate.

The water-cooled rolls hitherto used have been metal rolls. The metal ones have not been fully satisfactory. For one thing, they have questionable durability to cope with the heat cycles involving contact with high-temperature steel sheets and internal water cooling and, for the other, they are not quite resistant to the surface wear due to friction with the steel sheets usually conveyed under tension ranging from about 0.5 to about 3 $kg/cm^2$.

In view of this, it has already been proposed to reinforce the water-cooled rolls with metal carbide coatings (Utility Model Application Publication No. 19317/1988) or metal oxide coatings (Patent Application Public Disclosure No. 136634/1986).

However, metal carbide coatings have high thermal conductivity values, and the non-uniformity of surface roughness has an adverse affect on the local rate of heat transfer. This can result in an uneven rate of cooling of the steel sheets.

It was to eliminate this disadvantage that spray coating with metal oxides was proposed. The metal oxides are low enough in thermal conductivity to prevent the non-uniformity of surface roughness from influencing the uniformity of the cooling rate. The metal oxide coatings, however, exhibit such poor peeling resistance under service conditions. In addition they frequently require a double-layer bonding coat of about 200 μm thick. If desirable effects are to be achieved, the sprayed metal oxide coating itself must have a thickness of at least 200 μm.

SUMMARY OF THE INVENTION

With the view to overcoming the problems of the prior art, the present invention proposes the application of a cermet sprayed coating of a metal oxide and a heat-resisting metal or heat-resisting alloy matrix to water-cooled rolls of the character described above.

The invention thus provides a water-cooled roll for cooling steel sheets characterized in that the roll surface that comes in contact with the steel sheets is spray-coated with a cermet composed of a metal oxide having a higher hardness and lower thermal conductivity than metals and a metal matrix of Ni- or Co-base heat-resisting alloy. The metal oxide is chosen from among $Al_2O_3$, $Cr_2O_3$, $SiO_2$, and $ZrO_2$, and the metal matrix consists of an MCrAlY (M=Co or Ni). Preferably, the metal oxide is alumina and the meal matrix, CoCrAlYTa.

DESCRIPTION OF THE PREFERRED EMBODIMENTS

Figure 1:
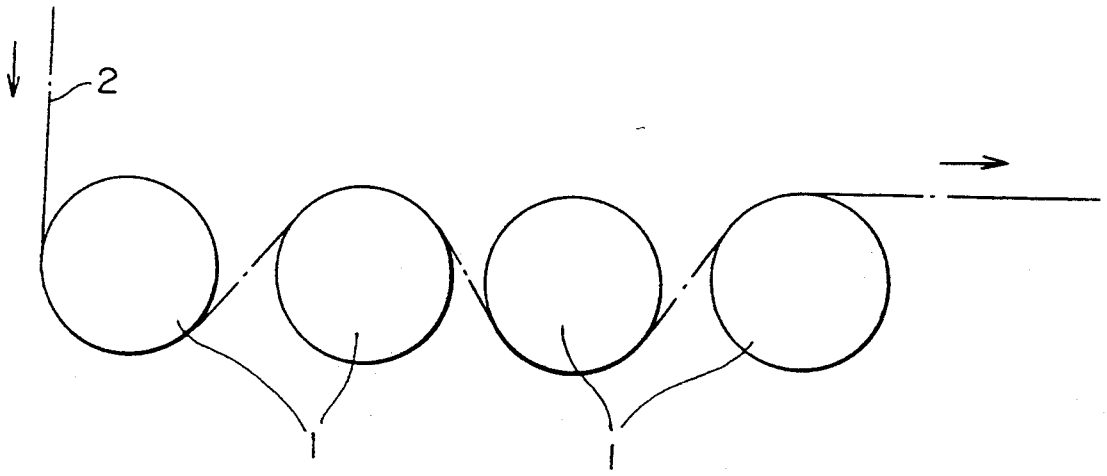
FIG. 1 is a schematic view of a roll type cooling arrangement.
Figure 2:
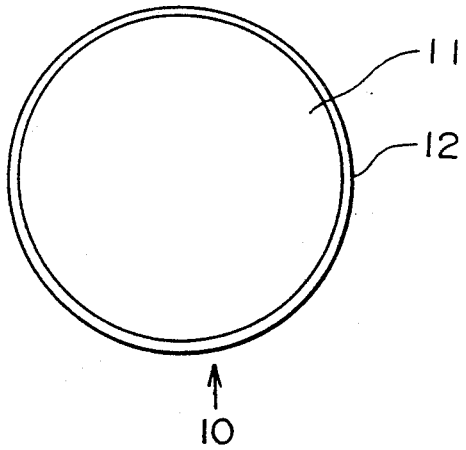
FIG. 2 is a diagrammatic view of a cooling roll embodying the present invention.
Figure 3:
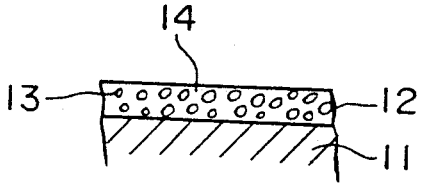
FIG. 3 is a fragmentary sectional view, on an enlarged scale, of the roll shown in FIG. 2.

Referring to the accompanying drawing, FIGS. 2 and 3 illustrate the construction of a water-cooled roll 10 according to the present invention. As shown, a conventional metal roll 11 which is cooled inside with water has a sprayed cermet coating 12 on the surface. The sprayed coating 12, as shown in FIG. 3, consists of metal oxide particles 13 dispersed in a matrix 14 of a heat-resisting metal or alloy. Such a sprayed coating can easily be formed by any known spraying technique, which involves spraying the materials, a metal oxide powder and a heat-resisting metal or alloy powder, onto a metal roll surface.

The metal roll may be built of any known material usually used for the purposes, e.g., carbon steel or heat-resisting cast steel.

Useful metal oxides for the invention include alumina, chromia, zirconia, and silica. Alumina is preferred because of its superior resistance to heat and wear.

Among the metal matrix materials which may be used in the present invention are Ni- and Co-base heat-resisting alloys. The high heat resistance and good binding properties with respect to the substrate make CoCrYTa and CoCrAlYTa particularly suitable.

The ratio of the metal oxide to the matrix ranges from 10:90 to 70:30, preferably from 30:70 to 60:40. A ratio chosen from this range permits the formation of a coating with an appropriately selected thermal conductivity and excellent exfoliation resistance. Thus, the uniformity of heat transfer of the roll can be secured.

Table 1 lists desirable examples of spray material compositions according to the invention.

TABLE 1

| Specimen No. | CoCrAlYTa | $Al_2O_3$ |
|---|---|---|
| 1 | 90 vol % | 10 vol % |
| 2 | 70 | 30 |
| 3 | 50 | 50 |
| 4 | 30 | 70 |
| 5 | 0 | 100 |
| 6 | NiCoCrAlY 90 | $Cr_2O_3$ 10 |

The sprayed coating formed in conformity with the invention is so adherent to the substrate that a bonding coat is not always necessary. Where necessary, a single-layer coat as thin as 30 μm or less in thickness is satisfactory.

The invention is illustrated by the following examples.

EXAMPLES

Coating materials of the compositions shown in Table 1 were prepared and applied to steel rolls by spray coating to form coatings about 50 μm thick.

These specimens were tested for their resistance to thermal shock. The thermal shock resistance was evaluated in terms of the number of thermal shock cycles, each of which consisting of holding each test specimen at 900° C. for 20 minutes and then placing it into water at 20° C., that the specimen withstood until its coating was peeled off. The results are summarized in Table 2.

TABLE 2

| Specimen No. | Oxide content vol % | No. of cycles before peeling |
|---|---|---|
| 1 | 10 | more than 20 |
| 2 | 30 | more than 20 |
| 3 | 50 | peeled in 15 |
| 4 | 70 | peeled in 5 |
| 5 | 100 | peeled in 1-2 |
| 6 | 10 | more than 20 |

As can be seen from Table 2, the use of a metal matrix markedly improves the adhesion of the resulting coating to the substrate over the coating of the metal oxide alone, making the coating more stable against thermal shock.

Next, thermal conductivity values of Specimens 1, 2, 3 of Table 1, CoCrYTa+$Al_2O_3$ (Specimen 6), and, for comparison purposes, $Cr_3C_2$ (65%)+Ni-Cr (35%), hard chromium plating, sprayed alumina coating (Specimen 5), and NiCoCrAlY+$Cr_2O_3$ 10% were determined, in cal/cm.sec° C. Table 3 gives the results.

TABLE 3

| Sprayed coating | Thermal Conductivity |
|---|---|
| $Cr_3C_2$ + Ni—Cr | 0.107 |
| Hard chromium | 0.16 |
| $Al_2O_3$ (Specimen 5) | 0.004 |
| $Al_2O_3$ 10% (Specimen 1) | 0.014 |
| $Al_2O_3$ 30% (Specimen 2) | 0.008 |
| $Al_2O_3$ 50% (Specimen 3) | 0.005 |
| CoCrYTa + $Al_2O_3$ (Specimen 6) | 0.014 |
| NiCoCrAlY + $Cr_2O_3$ 10% | 0.016 |

As Table 3 indicates, the cermet type sprayed coatings have considerably low thermal conductivity values compared with the metal types. By adjusting thickness in conjunction with thermal conductivity, the desired resistance to heat flow can be achieved with great tolerance for surface irregularity.

Specimens 1 and 6 were further tested for wear resistance. The test was carried out by subjecting each specimen to 200 cycles of sliding runs at 1070° C. and then measuring the abrasion quantity. By way of comparison, the sprayed coating of $Cr_3C_2$+Ni-Cr, a dispersed system rather than an oxide system, was likewise tested. Table 4 shows the results.

TABLE 4

| Sprayed Coating | Abrasion Loss |
|---|---|
| $Cr_3Cr_2$ + Ni—Cr | 18.0 $mm^3$ |
| $Al_2O_3$ 10% (Specimen 1) | 4.0 |
| CoCrYTa + $Al_2O_3$ (Specimen 6) | 4.1 |

As is clear from Table 4, the abrasion quantities indicate that the coatings composed of an oxide and a metal matrix were outstandingly resistant to wear.

As will be understood from the foregoing, the adjustment of the metal oxide content in a metal matrix makes it possible to choose a proper thermal conductivity and secure the uniformity of the cooling rate of the roll.

The spray coating has only to form a single layer rather than two over a water-cooled roll, and the sprayed coating may be as thin as 30 μm thick, thus making for a reduction of the spraying cost.

The sprayed cermet coatings according to the invention are superior in high-temperature wear resistance to the metal carbide systems and exhibit greater thermal shock resistance than metal oxide coatings.

What is claimed is:

1. A water-cooled roll for cooling a steel sheet comprising a water-cooled roll body having a surface and a cermet coating formed on the surface of the roll body that comes in contact with the steel sheet, said coating consisting essentially of a metal oxide selected from the group consisting of $Al_2O_3$, $CR_2O_3$, $SiO_2$, and $ZrO_2$ and a metal matrix selected from the group consisting of CoCrYTa, and CoCrAlYTa.

2. The water-cooled roll according to claim 1 wherein the metal matrix consists of CoCrYTa.

3. The water-cooled roll according to claim 1 wherein the metal matrix consists of CoCrAlYTa.

4. A water-cooled roll for cooling a steel sheet comprising a water-cooled roll body having a surface and a cermet coating formed on the surface of the roll body that comes in contact with a steel sheet, said coating being composed of a metal oxide selected from the group consisting of $Al_2O_3$, $CR_2O_3$, $SiO_2$, and $ZrO_2$ and a metal matrix comprising NiCrAlY.

* * * * *